US012630979B2

(12) United States Patent
Pang et al.

(10) Patent No.: US 12,630,979 B2
(45) Date of Patent: May 19, 2026

(54) CELLULOSIC STRUCTURES FOR HIGH BARRIER APPLICATIONS

(71) Applicant: WestRock MWV, LLC, Atlanta, GA (US)

(72) Inventors: Jiebin Pang, Glen Allen, VA (US); Taylor A. Drucker, Glen Allen, VA (US); Natasha G. Melton, Henrico, VA (US)

(73) Assignee: WestRock MWV, LLC, Atlanta, GA (US)

( * ) Notice: Subject to any disclaimer, the term of this patent is extended or adjusted under 35 U.S.C. 154(b) by 459 days.

(21) Appl. No.: 18/189,508

(22) Filed: Mar. 24, 2023

(65) Prior Publication Data

US 2023/0416993 A1 Dec. 28, 2023

Related U.S. Application Data

(60) Provisional application No. 63/356,078, filed on Jun. 28, 2022.

(51) Int. Cl.

| | |
|---|---|
| ***D21H 19/82*** | (2006.01) |
| ***D21H 19/24*** | (2006.01) |
| ***D21H 19/56*** | (2006.01) |

(52) U.S. Cl.

CPC ..... *D21H 19/828* (2013.01); *D21H 19/24* (2013.01); *D21H 19/56* (2013.01)

(58) Field of Classification Search

None

See application file for complete search history.

(56) References Cited

U.S. PATENT DOCUMENTS

| | | | |
|---|---|---|---|
| 7,235,308 | B2 | 6/2007 | Druckrey et al. |
| 9,028,921 | B2 | 5/2015 | Dandenault et al. |
| 9,200,409 | B2 | 12/2015 | Hartmann et al. |
| 9,950,502 | B2 | 4/2018 | Seyffer |
| 9,994,999 | B2 | 6/2018 | Axrup et al. |
| 10,562,659 | B2 | 2/2020 | Fortin et al. |
| 10,590,606 | B2 | 3/2020 | Mongrain et al. |
| 10,829,894 | B2 | 11/2020 | Mongrain |
| 2019/0291134 | A1 | 9/2019 | Mongrain |
| 2020/0131708 | A1 | 4/2020 | Triclot et al. |
| 2021/0017717 | A1 | 1/2021 | Backfolk et al. |

(Continued)

FOREIGN PATENT DOCUMENTS

| | | |
|---|---|---|
| EP | 3 929 355 | 12/2021 |
| WO | WO 2020/152635 | 7/2020 |

(Continued)

OTHER PUBLICATIONS

European Patent Office: International Search Report and Written Opinion, Intl. App. No. PCT/US2023/064928 (Jun. 28, 2023).

*Primary Examiner* — Dennis R Cordray

(74) *Attorney, Agent, or Firm* — Neil G. Cohen; Rohini K. Garg

(57) ABSTRACT

A cellulosic substrate includes a first major side and a second major side opposed from the first major side, a single polyolefin aqueous polymer dispersion barrier layer on the first major side of the cellulosic substrate, and at least one non-polyolefin aqueous polymer dispersion barrier layer between the single polyolefin aqueous polymer dispersion barrier layer and the first major side of the cellulosic substrate.

26 Claims, 3 Drawing Sheets

(56) References Cited

U.S. PATENT DOCUMENTS

| | | | | |
|---|---|---|---|---|
| 2021/0025114 | A1 | 1/2021 | Mongrain et al. | |
| 2022/0016875 | A1* | 1/2022 | Fortin | B32B 27/40 |
| 2022/0162804 | A1* | 5/2022 | Nyflött | D21H 19/48 |
| 2022/0316135 | A1* | 10/2022 | Setälä | D21C 9/005 |

FOREIGN PATENT DOCUMENTS

| | | |
|---|---|---|
| WO | WO 2021/234559 | 11/2021 |
| WO | WO 2022/018621 | 1/2022 |

* cited by examiner

CELLULOSIC STRUCTURES FOR HIGH BARRIER APPLICATIONS

PRIORITY

This application claims priority from U.S. Ser. No. 63/356,078 filed on Jun. 28, 2022, the entire contents of which are incorporated herein by reference.

FIELD

This application is directed to the field of cellulosic structures and, more particularly, to cellulosic structures useful, for example, for high barrier applications.

BACKGROUND

Sustainability is one of the key drivers in the development of new packages for food, food service, personal care, pharmaceutical, and e-commerce packaging applications. Participants in these industries are often seeking more sustainable alternatives to replace single-use plastic packaging materials.

Cellulose fiber-based paper or paperboard is considered a viable option to replace single-use plastic packaging materials. However, paper or paperboard themselves do not provide functionalities, such as barrier, to meet the performance requirements in most packaging applications. Paper or paperboard laminated with aluminum foil, plastic film, or extrusion polymer (e.g., polyethylene) coatings can meet the barrier performance needs, but the resultant packages are not easily recyclable, causing concerns on environmental impact.

Paper or paperboard coated with aqueous coatings are generally considered repulpable and recyclable and, thus, more sustainable. However, aqueous coated paper or paperboard does not exhibit the same performance, including barrier properties, as polymer extrusion coated or laminated paper or paperboard.

Accordingly, those skilled in the art continue with research and development efforts in the field of cellulosic structures.

SUMMARY

Disclosed are cellulosic structures.

In one example, the disclosed cellulosic structure includes a cellulosic substrate including a first major side and a second major side opposed from the first major side, a single polyolefin aqueous polymer dispersion barrier layer on the first major side of the cellulosic substrate, and at least one non-polyolefin aqueous polymer dispersion barrier layer between the single polyolefin aqueous polymer dispersion barrier layer and the first major side of the cellulosic substrate.

Also disclosed are containers.

In one example, the disclosed container includes a cellulosic structure, which includes a cellulosic substrate including a first major side and a second major side opposed from the first major side, a single polyolefin aqueous polymer dispersion barrier layer on the first major side of the cellulosic substrate, and at least one non-polyolefin aqueous polymer dispersion barrier layer between the single polyolefin aqueous polymer dispersion barrier layer and the first major side of the cellulosic substrate.

Other examples of the disclosed cellulosic structures and containers will become apparent from the following detailed description, the accompanying drawings and the appended claims.

DETAILED DESCRIPTION

Figure 1:
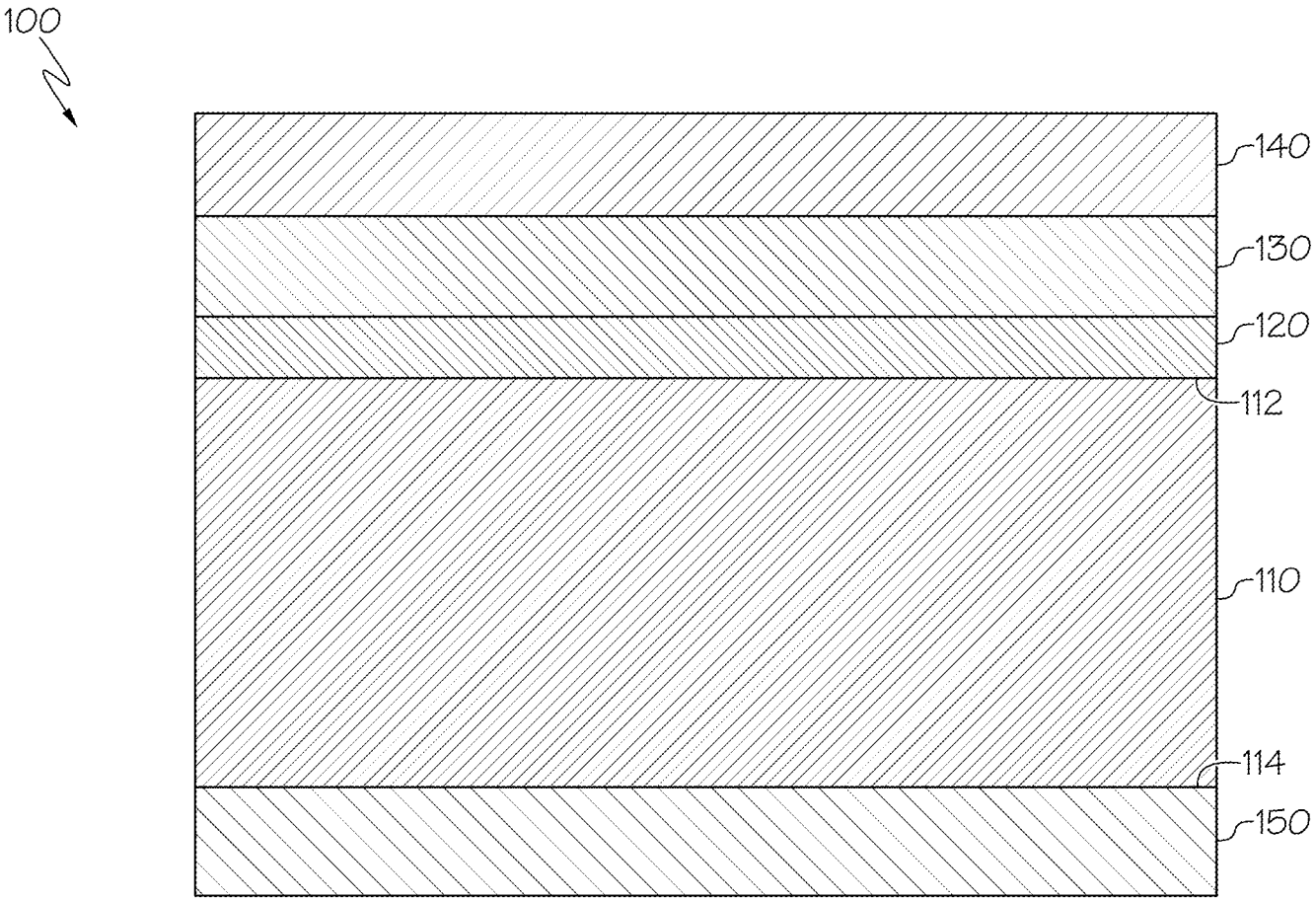
FIG. 1 is a representation of a cross-section of an exemplary cellulosic structure of the present description.

Disclosed is a sustainable, multi-functional barrier cellulosic structure with excellent barrier properties, which are close to the barrier properties offered by typical polymer extrusion coated paperboard. Also disclosed are containers manufactured from the disclosed cellulosic structures.

According to the present description, the cellulosic structure includes a cellulosic substrate including a first major side and a second major side opposed from the first major side, a single polyolefin aqueous polymer dispersion barrier layer on the first major side of the cellulosic substrate, and at least one non-polyolefin aqueous polymer dispersion barrier layer between the single polyolefin aqueous polymer dispersion barrier layer and the first major side of the cellulosic substrate.

The cellulosic substrate of the cellulosic structure may be (or may include) any cellulosic material that is capable of being coated with the layers of the present description. Those skilled in the art will appreciate that the cellulosic substrate may be bleached or unbleached. In one nonlimiting example the cellulosic substrate may be paperboard. In another nonlimiting example the cellulosic substrate may be solid bleached sulfate (SBS). Examples of appropriate cellulosic substrates include paper, corrugating medium, linerboard, and unbleached kraft. One specific, nonlimiting example of a suitable cellulosic substrate is TruServ™ Poly Cupstock SBS, 11 pt (140 lb/3000 $ft^2$), 13 pt (150 lb/3000 $ft^2$), or 18 pt (185 lb/3000 $ft^2$), from WestRock.

In an aspect, the cellulosic structure of the present description is particularly for packaging applications. The cellulosic structure is preferably selected to have a high enough basis weight for such packaging applications. In an aspect, the cellulosic substrate may have a basis weight of at least about 25 lb/3000 $ft^2$. In another aspect, the cellulosic substrate may have a basis weight ranging from about 60 lb/3000 $ft^2$ to about 400 lb/3000 $ft^2$. In another aspect, the cellulosic substrate may have a basis weight ranging from about 80 lb/3000 $ft^2$ to about 300 lb/3000 $ft^2$. The cellulosic structure is preferably selected to have a high enough thickness for such packaging applications. In an aspect, the cellulosic substrate may have a caliper ranging from about 2 points to about 30 points. In another aspect, the cellulosic substrate may have a caliper ranging from about 11 points to about 18 points.

According to an aspect of the present description, the single polyolefin aqueous polymer dispersion barrier layer includes a polyolefin binder. According to another aspect of the present description, the single polyolefin aqueous polymer dispersion barrier layer includes a pigment. The pigment may include, for example, a clay and or a calcium carbonate. Other pigments, such as plastic pigments, titanium dioxide pigment, talc pigment and the like, may be used without departing from the scope of the present disclosure. A ratio of the binder to the pigment is preferably at least 1 to 2.

The single polyolefin aqueous polymer dispersion barrier layer may preferably have a coat weight, on a dry basis, of at least about 0.5 lb/3000 $ft^2$, such as in a range from about 0.5 lb/3000 $ft^2$ to about 20 lb/3000 $ft^2$, preferably ranging from about 3 lb/3000 $ft^2$ to about 12 lb/3000 $ft^2$, more preferably ranging from about 6 lb/3000 $ft^2$ to about 10 lb/3000 $ft^2$.

The single polyolefin aqueous polymer dispersion barrier layer improves a barrier property, including at least one of water, moisture vapor, oil and grease, and oxygen transmission barrier, of the cellulosic structure and a non-blocking property of the cellulosic structure without undermining a repulpability property of the cellulosic structure.

According to an aspect of the present description, the non-polyolefin aqueous polymer dispersion barrier layer includes a non-polyolefin binder, which may be (or may include) a styrene acrylic binder, a styrene-butadiene binder, a vinyl acrylic binder, or a polyester dispersion binder. According to another aspect of the present description, the non-polyolefin aqueous polymer dispersion barrier layer includes a pigment. The pigment may include, for example, a clay and or a calcium carbonate. The pigment component of the non-polyolefin aqueous polymer dispersion barrier layer may be (or may include) various materials. Five nonlimiting examples of suitable inorganic pigments are presented in Table 1. Other pigments, such as plastic pigments, titanium dioxide pigment, talc pigment and the like, may be used without departing from the scope of the present disclosure.

A ratio of the binder to the pigment is preferably at least 1 to 2. The at least one non-polyolefin aqueous polymer dispersion barrier layer may be a single non-polyolefin aqueous polymer dispersion barrier layer or may include multiple non-polyolefin aqueous polymer dispersion barrier layers.

The non-polyolefin aqueous polymer dispersion barrier layer may preferably have a total coat weight, on a dry basis, of at least about 0.5 lb/3000 $ft^2$. In an aspect, the non-polyolefin aqueous polymer dispersion barrier layer may have a coat weight, on a dry basis, ranging from about 0.5 lb/3000 $ft^2$ to about 20 lb/3000 $ft^2$. In another aspect, the non-polyolefin aqueous polymer dispersion barrier layer may have a coat weight, on a dry basis, ranging from about 3 lb/3000 $ft^2$ to about 12 lb/3000 $ft^2$. In another aspect, the non-polyolefin aqueous polymer dispersion barrier layer may have a coat weight, on a dry basis, ranging from about 6 lb/3000 $ft^2$ to about 10 lb/3000 $ft^2$.

The non-polyolefin aqueous polymer dispersion barrier layer provides for a high barrier property, including at least one of water, moisture vapor, oil and grease, and oxygen transmission barrier, of the cellulosic structure cellulosic structure and a repulpability property of the cellulosic structure.

According to an aspect of the present description, the cellulosic structure may further include at least one water soluble polymer barrier layer between the single polyolefin aqueous polymer dispersion barrier layer and the first major side of the cellulosic substrate. In an aspect, the water soluble polymer barrier layer may be between the single polyolefin aqueous polymer dispersion barrier layer and the at least one non-polyolefin aqueous polymer dispersion barrier layer. In another aspect, the water soluble polymer barrier layer may be between the at least one non-polyolefin aqueous polymer dispersion barrier layer and the first major side of the cellulosic substrate.

According to an aspect of the present description, the water soluble polymer barrier layer includes a non-polyolefin binder, which may be (or may include) a polyvinyl alcohol binder, a carboxymethylcellulose binder, or an alginate binder. In a preferred aspect, the water soluble binder is a polyvinyl alcohol binder.

According to another aspect of the present description, the water soluble polymer barrier layer includes a pigment. The pigment may include, for example, a clay and or a calcium carbonate. The pigment component of the water soluble polymer barrier layer may be (or may include) various materials. Five nonlimiting examples of suitable inorganic pigments are presented in Table 1. Other pigments, such as plastic pigments, titanium dioxide pigment, talc pigment and the like, may be used without departing from the scope of the present disclosure.

A ratio of the binder to the pigment is preferably at least 1 to 1. The at least one water soluble polymer barrier layer may be a single water soluble polymer barrier layer or may include multiple water soluble polymer barrier layers.

The water soluble polymer barrier layer may preferably have a coat weight, on a dry basis, of at least about 0.5 lb/3000 $ft^2$. In an aspect, the water soluble polymer barrier layer may have a coat weight, on a dry basis, ranging from about 0.5 lb/3000 $ft^2$ to about 20 lb/3000 $ft^2$. In another aspect, the water soluble polymer barrier layer may have a coat weight, on a dry basis, ranging from about 1 lb/3000 $ft^2$ to about 10 lb/3000 $ft^2$. In another aspect, the water soluble polymer barrier layer may have a coat weight, on a dry basis, ranging from about 3 lb/3000 $ft^2$ to about 5 lb/3000 $ft^2$.

The water soluble polymer barrier layer further enhances a barrier property including oxygen barrier of the cellulosic structure cellulosic structure and a repulpability property of the cellulosic structure. The water soluble polymer barrier layer may also function as a primer layer that is suitable for direct application on a major side of the cellulosic substrate.

The combination of barrier layers may function to provide high barrier properties to water, moisture vapor, oil and grease, and oxygen transmission and provide non-blocking and repulpability.

The cellulosic structure of the present description may further include one or more additional coating layers positioned between the single polyolefin aqueous polymer dispersion barrier layer and the first major side of the cellulosic substrate.

According to the present description, the second major side of the cellulosic substrate may be uncoated or coated. In an aspect, the second major side may include a barrier layer thereon. The barrier layer on the second major side may be the same as one or more of the barrier layers on the first major side, or the barrier layer may be a different barrier layer. In another aspect, the second major side may include a non-barrier layer thereon, such as a clay coating layer on the second major side of the cellulosic substrate. The second major side of the cellulosic substrate may include both a non-barrier layer and a barrier layer. The second major side may preferable define an outside of a container formed from the cellulosic substrate.

Various techniques may be used for forming the coatings of the present description, such as one or more coaters either on the paper machine or as off-machine coater(s). One specific, nonlimiting example of a suitable method is using a blade coater for applying the coating layers.

According to an aspect of the present description, the cellulosic substrate may be provided with a 30-minute-water-Cobb rating of at most about 20 g/m$^2$, preferably a 30-minute-water-Cobb rating of at most about 10 g/m$^2$, more preferably a 30-minute-water-Cobb rating of at most about 5 g/m$^2$, more preferably a 30-minute-water-Cobb rating of at most about 4 g/m$^2$, more preferably a 30-minute-water-Cobb rating of at most about 3 g/m$^2$, more preferably a 30-minute-water-Cobb rating of at most about 2 g/m$^2$.

According to an aspect of the present description, the cellulosic substrate may be provided with a water vapor transmission rate of less than 1000 grams per square meter per day at 38° C./90% RH, preferably a water vapor transmission rate of less than 500 grams per square meter per day at 38° C./90% RH, more preferably a water vapor transmission rate of less than 400 grams per square meter per day at 38° C./90% RH, more preferably a water vapor transmission rate of less than 300 grams per square meter per day at 38° C./90% RH, more preferably a water vapor transmission rate of less than 200 grams per square meter per day at 38° C./90% RH, more preferably a water vapor transmission rate of less than 100 grams per square meter per day at 38° C./90% RH.

According to an aspect of the present description, the cellulosic substrate may be provided with an oxygen transmission rate of less than 500 cc per square meter per day at 23° C./0% RH/100% $O_2$, more preferably an oxygen transmission rate of less than 200 cc per square meter per day at 23° C./0% RH/100% $O_2$, more preferably an oxygen transmission rate of less than 150 cc per square meter per day at 23° C./0% RH/100% $O_2$, more preferably an oxygen transmission rate of less than 140 cc per square meter per day at 23° C./0% RH/100% $O_2$, more preferably an oxygen transmission rate of less than 130 cc per square meter per day at 23° C./0% RH/100% $O_2$, more preferably an oxygen transmission rate of less than 120 cc per square meter per day at 23° C./0% RH/100% $O_2$, more preferably an oxygen transmission rate of less than 110 cc per square meter per day at 23° C./0% RH/100% $O_2$.

According to an aspect of the present description, the cellulosic substrate may be provided with a 3M kit test value is at least 5, more preferably a 3M kit test value is at least 6, more preferably a 3M kit test value is at least 7, more preferably a 3M kit test value is at least 8, more preferably a 3M kit test value is at least 9, more preferably a 3M kit test value is at least 10, more preferably a 3M kit test value is at least 11, more preferably a 3M kit test value is at least 12.

According to an aspect of the present description, the cellulosic substrate may be provided with a blocking rating of 2.0 or less, more preferably a blocking rating of 1.5 or less, more preferably a blocking rating of 1.0 or less, more preferably a blocking rating of 0.7 or less, more preferably a blocking rating of 0.2 or less, more preferably a blocking rating of 0.1 or less.

According to an aspect of the present description, the cellulosic substrate may be provided with repulpable to the extent that after repulping the percentage accepts is at least 50%, more preferably repulpable to the extent that after repulping the percentage accepts is at least 70%, more preferably repulpable to the extent that after repulping the percentage accepts is at least 80%, more preferably repulpable to the extent that after repulping the percentage accepts is at least 85%, more preferably repulpable to the extent that after repulping the percentage accepts is at least 90%.

The cellulosic structure may be particularly suitable for forming a container including the cellulosic structure.

Referring to FIG. 1, an exemplary cellulosic structure 100 may be a layered structure that includes a cellulosic substrate 110 having a first major side 112 and a second major side 114. A water soluble polymer barrier layer 120 is applied to a major side (e.g., the first major side 112) of the cellulosic substrate 110. A non-polyolefin aqueous polymer dispersion barrier layer 130 is applied on the water soluble polymer barrier layer 120. A single polyolefin aqueous polymer dispersion barrier layer 140 is applied on the non-polyolefin aqueous polymer dispersion barrier layer 130. The single polyolefin aqueous polymer dispersion barrier layer 130 defines an outermost surface of the cellulosic structure 100, which may preferably correspond to an interior surface of a container. In an alternative example, the order of the water soluble polymer barrier layer 120 and the non-polyolefin aqueous polymer dispersion barrier layer 130 may be switched such that the non-polyolefin aqueous polymer dispersion barrier layer 130 is applied to the first major side 112 of the cellulosic substrate 110 and the water soluble polymer barrier layer 120 is applied on the non-polyolefin aqueous polymer dispersion barrier layer 130. In another alternative example, the water soluble polymer barrier layer 120 may be omitted such that the non-polyolefin aqueous polymer dispersion barrier layer 130 is applied to the first major side 112 of the cellulosic substrate 110 and the single polyolefin aqueous polymer dispersion barrier layer 140 is applied on the non-polyolefin aqueous polymer dispersion barrier layer 130. In yet another alternative example, the water soluble polymer barrier layer 120 may be omitted and a primer layer may be applied to first major side 112 of the cellulosic substrate 110 and the non-polyolefin aqueous polymer dispersion barrier layer 130 may be applied on the primer layer. In yet another alternative example, the water soluble polymer barrier layer 120 may be included and a primer layer may be applied to first major side 112 of the cellulosic substrate 110 and the water soluble polymer barrier layer 120 may be applied on the primer layer. The cellulosic substrate 110 may include one or multiple water soluble polymer barrier layers 120 and one or multiple non-polyolefin aqueous polymer dispersion barrier layers 130. A single polyolefin aqueous polymer dispersion barrier layer 140 is included in the cellulosic substrate 110. One or more additional coatings 150 may be applied to the second major side 114 or the second major side 114 may remain uncoated.

Experimental Examples

Figure 2:
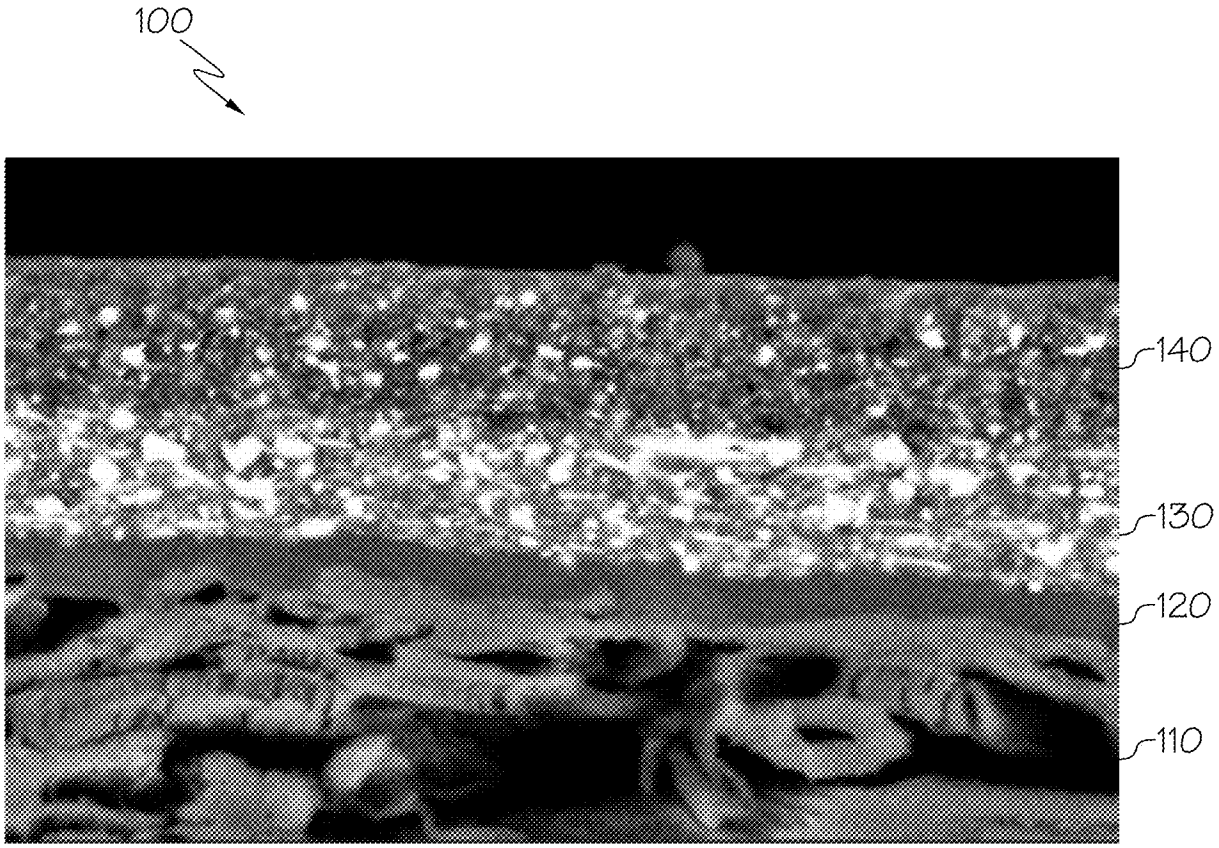
FIG. 2 is an SEM image of a cross-section of an exemplary cellulosic structure of the present description, showing three layers of barrier coating.

FIG. 2 is an SEM image of a cross-section of an exemplary cellulosic structure 100 of the present description, showing three layers of barrier coatings 120, 130, 140 on a cellulosic substrate 110.

First, a water soluble polymer barrier coating (PBC) was applied to a major side of the cellulosic substrate. More particularly, Exceval™ HR-3010, a modified polyvinyl alcohol (PVOH) resin, supplied by Kuraray America Inc., Houston, TX, was employed as the water soluble polymer barrier layer. The PVOH solution was prepared by first dispersing the resin powder into water at room temperature under stirring. Then, the temperature of the mixture was raised by steam to 90-95° C. and was maintained under mixing for about for 30 minutes. The solution was then cooled to room temperature and any foam floated to top of the solution was removed. Solids content of the solution was 10.2-11.2% measured by a CEM SMART 6 moisture analyzer, and viscosity of the solution was 368-630 cP (centipoise) measured by a Brookfield DV2T Viscometer at 100 rpm using a #2 spindle.

Second, a non-polyolefin aqueous polymer dispersion barrier layer was applied as a middle barrier coating (MBC) on the water soluble polymer barrier coating. More particularly, various non-polyolefin aqueous polymer dispersion barrier layers were selected from the raw materials and formulations (by weight ratios) listed in Tables 1 and 2 below and applied at the coat weights and on the substrates listed in Table 3.

Third, a single polyolefin aqueous polymer dispersion barrier layer was applied as a top barrier coating (TBC) on the middle barrier coating. More particularly, various single polyolefin aqueous polymer dispersion barrier layers were selected from the raw materials and formulations (by weight ratios) listed in Tables 1 and 2 below and applied at the coat weights and on the substrates listed in Table 3.

Substrates were selected from:

(1). TruServ™ Poly Cupstock SBS, 11 pt (140 lb/3000F2), 13 pt (150 lb/3000F2), or 18 pt (185 lb/3000F2), from WestRock; the felt side of the paperboard was coated.

(2). PolarShield™ Frozen Cup, 14 pt (163 lb/3000F2), from WestRock; A clay-coated base provides a smooth surface to maximize printability and promote high graphic standards; The non-clay-coated side was coated with the example barrier coatings in this invention.

All coatings were applied on a blade coater.

TABLE 1

| | | Product | Description |
|---|---|---|---|
| Pigment | CC-1 | HYDROCARB ® 60 (Omya AG, Oftringen, Switzerland) | coarse ground $CaCO_3$ (particle size 60% < 2 micron) |
| Pigment | CC-2 | HYDROCARB ® 90 (Omya AG, Oftringen, Switzerland) | fine ground $CaCO_3$ (particle size 90% < 2 micron) |

TABLE 1-continued

| | | Product | Description |
|---|---|---|---|
| Pigment | CL-1 | BARRISURF ™ XP (IMERYS Kaolin, Georgia) | platy clay with high aspect ratio |
| Pigment | CL-2 | BARRISURF ™ HX (IMERYS Kaolin, Georgia) | platy clay with high aspect ratio |
| Pigment | CL-3 | HYDRAFINE ® 90W (KaMin LLC of Macon, Georgia) | kaolin clay No. 1 ultrafine clay |
| Binder | SA | CARTASEAL ® SCR (Archroma, Reinach, Switzerland) | water based acrylic emulsion polymer |
| Binder | SB | PB 6692MNA (Trinseo, Pennsylvania) | water based modified styrene butadiene (SB) latex binder |
| Binder | POD | RHOBARR ™ 320 Polyolefin Dispersion (The Dow Chemical Company, Michigan) | aqueous acid-modified polyolefin dispersion, 43 ± 2.0% solids |

TABLE 2

| Formulation | Non-polyolefin aqueous polymer dispersion barrier layer | | | Polyolefin aqueous polymer dispersion barrier layer |
|---|---|---|---|---|
| (in Parts) | MBC-1 | MBC-2 | MBC-3 | TBC-1 |
| CaCO3 (CC-1) | 65 | 50 | | |
| CaCO3 (CC-2) | | | | 50 |
| Clay (CL-1) | 35 | | | |
| Clay (CL-2) | | 50 | 100 | |
| Clay (CL-3) | | | | 50 |
| Binder (SA) | 250 | | | |
| Binder (SB) | | 100 | 100 | |
| Binder (POD) | | | | 250 |

TABLE 3

| Sample ID | A | B | C | D | E | F | G | H |
|---|---|---|---|---|---|---|---|---|
| Substrate | 11 pt TruServ | 11 pt TruServ | 13 pt TruServ | 18 pt TruServ | 13 pt TruServ | 14 pt PolarShield | 13 pt TruServ | 14 pt PolarShield |
| PBC | PVOH | PVOH | PVOH | PVOH | PVOH | PVOH | | |
| PBC Coat Weight (lb/3 msf) | 3 | 3.9 | 4.2 | 2.5 | 3.6 | 2.4 | | |
| MBC | MBC-1 | MBC-1 | MBC-1 | MBC-1 | MBC-2 | MBC-2 | MBC-3 | MBC-3 |
| MBC Coat Weight (lb/3000 F2) | 7.3 | 7.3 | 7 | 6.8 | 7.2 | 6.9 | 9.2/3.4 | 9.4/2.6 |
| TBC | TBC-1 | TBC-1 | TBC-1 | TBC-1 | TBC-1 | TBC-1 | TBC-1 | TBC-1 |
| TBC Coat Weight (lb/3 msf) | 7 | 6.9 | 7.1 | 7 | 7.9 | 7.9 | 8.8 | 8.4 |
| H2O Cobb (g/m2, 30 min) | 2.6 | 3.2 | 1.9 | 2.6 | 1.4 | 3.5 | 2.9 | 1.1 |
| WVTR (g/m2/d, 38° C./90% RH) | 147 | 103 | 100 | 168 | 106 | 319 | 65.4 | 71.1 |
| OTR (cm3/m2/d, 23° C./0 % RH/100% O2) | 127 | 130 | | 120 | 100 | | | |
| 3M Kit | | | | | 11 | 12 | 12 | 12 |
| Blocking | 0 | 0.2 | 0.4 | 0.2 | 1 | 0 | 0.7 | 0 |
| Repulpability (% fiber accepts) | 85% | | 87% | 90% | 92% | 88% | 93% | 85.40% |

The experimental results are shown in Table 3. The results show that the combination of barrier layers provide high barrier properties to water, moisture vapor, oil and grease, and oxygen transmission and provide non-blocking and repulpability.

Water barrier property of the coatings was evaluated by water Cobb (TAPPI Standard T441 om-04) in $g/m^2$ per 30 minutes, using 23° C. water. In other words, the Cobb test determines how much water is absorbed after 30 minutes.

Water vapor barrier properties test was performed: WVTR (water vapor transmission rate, in $g/m^2/d$) was measured at 38° C. and 90% relative humidity according to TAPPI Standard T464 OM-12.

The oil and grease resistance (OGR) of the samples was measured on the "coated side" by the 3M kit test (TAPPI Standard T559 cm-02). With this test, ratings are from 1 (the least resistance to oil and grease) to 12 (excellent resistance to oil and grease penetration).

Oxygen barrier properties test: OTR (oxygen transmission rate, in $cm^3/m^2/d$) was measured on a LabThink C230B OTR Test System under setting conditions of 0% RH, 23° C., 100% $O_2$.

Repulpability was tested using an AMC Maelstom repulper. 110 grams of coated paperboard, cut into 1-inch by 1-inch squares, was added to the repulper containing 2895 grams of water (pH of 6.5±0.5, 50° C.), soaked for 15 minutes, and then repulped for 30 minutes. 300 mL of the repulped slurry was then screened through a vibrating flat screen (0.006-inch slot size). Rejects (caught by the screen) and fiber accepts were collected, dried and weighed. The percentage of accepts was calculated based on the weights of accepts and rejects, with 100% being complete repulpability.

The blocking rating (50° C./100 psi/24 hrs) was tested for all examples. Table 4 defines the blocking test rating system.

TABLE 4

| Rating | Description |
|---|---|
| 0 | Samples fall apart without any force applied |
| 1 | Samples have a light tackiness but separate without fiber tear |
| 2 | Samples have a high tackiness but separate without fiber tear |
| 3 | Samples are sticky and up to 25% fiber tear or coat damage (area basis) |
| 4 | Samples have more than 25% fiber tear or coat damage (area basis) |

Figure 3:
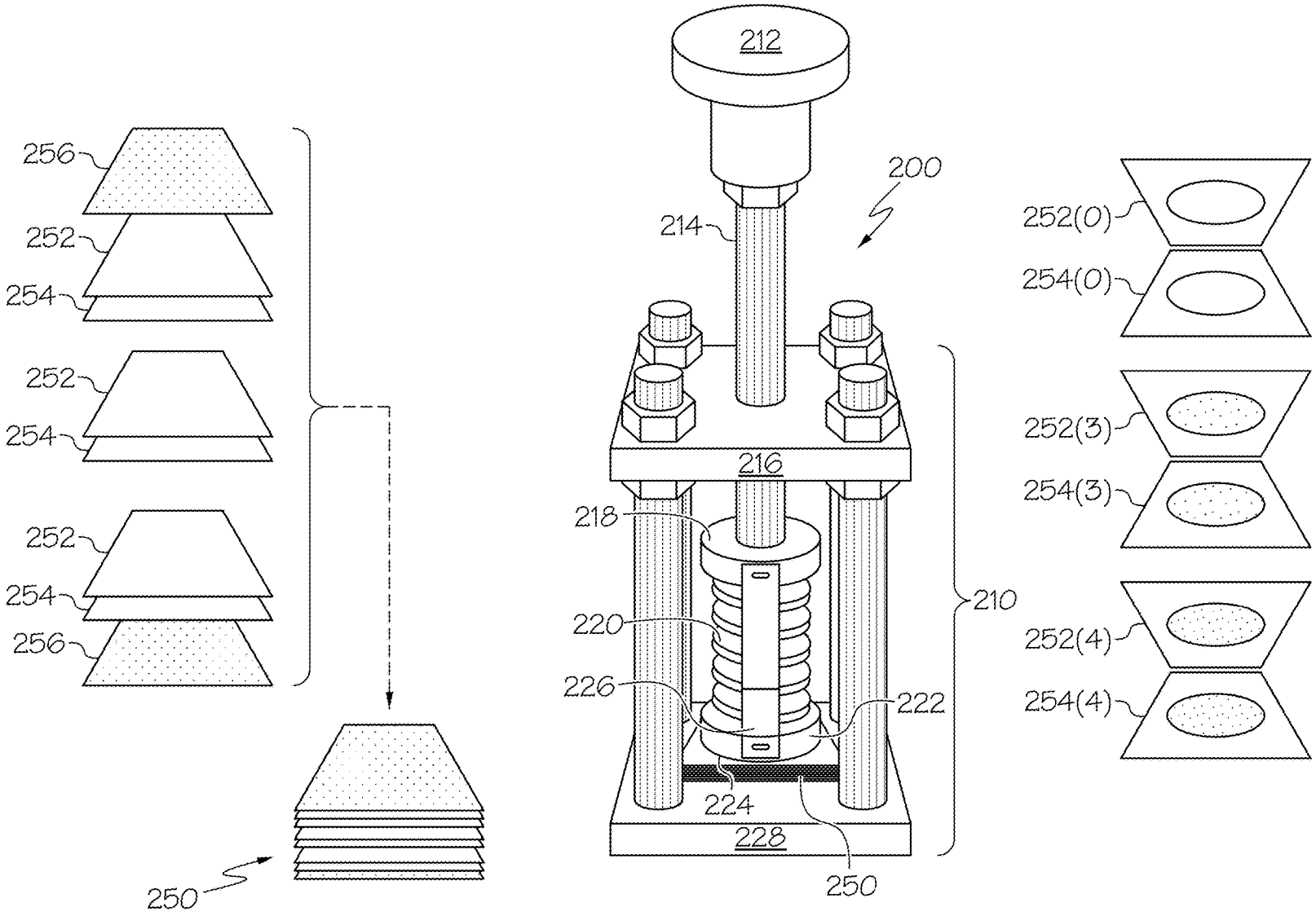
FIG. 3 is an illustration of a device for testing blocking of coated paperboard samples.

The blocking behavior of the samples was tested by evaluating the adhesion between the barrier coated side and the other uncoated side. A simplified illustration of the blocking test is shown in FIG. 3. The paperboard was cut into 2-inch by 2-inch square samples. Several duplicates were tested for each condition, with each duplicate evaluating the blocking between a pair of samples 252, 254. (For example, if four duplicates were test, four pairs—eight pieces—would be used.) Each pair was positioned with the 'barrier-coated' side of one piece 252 contacting the uncoated side of the other piece 254. The pairs were placed into a stack 250 with a spacer 256 between adjacent pairs, the spacer being foil, release paper, or even copy paper. The entire sample stack was placed into the test device 200 illustrated in FIG. 3.

The test device 200 includes a frame 210. An adjustment knob 212 is attached to a screw 214 which is threaded through the frame top 216. The lower end of screw 214 is attached to a plate 218 which bears upon a heavy coil spring 220. The lower end of the spring 220 bears upon a plate 222 whose lower surface 224 has an area of one square inch. A scale 226 enables the user to read the applied force (which is equal to the pressure applied to the stack of samples through the one-square-inch lower surface 224).

The stack 250 of samples is placed between lower surface 224 and the frame bottom 228. The knob 212 is tightened until the scale 226 reads the desired force of 100 lbf (100 psi applied to the samples) or 60 lbf (60 psi applied to the samples). High pressure such as 1000 psi is achieved by reducing the lower surface area of 224 contacting the stack 250 of samples to 0.11 square inch, with an applied force of 110 lb. The entire device 200 including samples is then placed in an oven at 50° C. for 24 hours or 2 hours. The device 200 is then removed from the test environment and cooled to room temperature. The pressure is then released, and the samples removed from the device.

The samples were evaluated for tackiness and blocking by separating each pair of paperboard sheets. Blocking damage is visible as fiber tear, which if present usually occurs with fibers pulling up from the non-barrier surface of samples 254. If the non-barrier surface was coated with a print coating, then blocking might also be evinced by damage to the print coating.

For example, in as symbolically depicted in FIG. 3, samples 252(0)/254(0) might be representative of a "0" rating (no blocking). The circular shape in the samples indicates an approximate area that was under pressure, for instance about one square inch of the overall sample. Samples 252(3)/254(3) might be representative of a "3" blocking rating, with up to 25% fiber tear in the area that was under pressure, particularly in the uncoated surface of sample 254(3). Samples 252(4)/254(4) might be representative of a "4" blocking rating with more than 25% fiber tear, particularly in the uncoated surface of sample 254(4). The depictions in FIG. 3 are only meant to approximately suggest the percent damage to such test samples, rather than showing a realistic appearance of the samples.

Further, the disclosure comprises examples according to the following clauses

Clause 1. A cellulosic structure comprising: a cellulosic substrate comprising a first major side and a second major side opposed from the first major side; a single polyolefin aqueous polymer dispersion barrier layer on the first major side of the cellulosic substrate; and at least one non-polyolefin aqueous polymer dispersion barrier layer between the single polyolefin aqueous polymer dispersion barrier layer and the first major side of the cellulosic substrate.

Clause 2. The cellulosic structure of Clause 1 wherein the cellulosic substrate comprises paperboard.

Clause 3. The cellulosic structure of Clause 2 wherein the paperboard comprises solid bleached sulfate paperboard.

Clause 4. The cellulosic structure of any one of Clauses 1-3 wherein the cellulosic substrate has a basis weight of at least about 25 lb/3000 $ft^2$.

Clause 5. The cellulosic structure of any one of Clauses 1-3 wherein the cellulosic substrate has a basis weight ranging from about 60 lb/3000 $ft^2$ to about 400 lb/3000 $ft^2$.

Clause 6. The cellulosic structure of any one of Clauses 1-3 wherein the cellulosic substrate has a basis weight ranging from about 80 lb/3000 $ft^2$ to about 300 lb/3000 $ft^2$.

Clause 7. The cellulosic structure of any one of Clauses 1-6 wherein the cellulosic substrate has a caliper ranging from about 2 points to about 30 points.

Clause 8. The cellulosic structure of any one of Clauses 1-6 wherein the cellulosic substrate has a caliper ranging from about 11 points to about 18 points.

Clause 9. The cellulosic structure of any preceding clause wherein the single polyolefin aqueous polymer dispersion barrier layer comprises a polyolefin binder.

Clause 10. The cellulosic structure of Clause 9 wherein the single polyolefin aqueous polymer dispersion barrier layer comprises a pigment.

Clause 11. The cellulosic structure of Clause 10 wherein the pigment comprises at least one of a clay and a calcium carbonate.

Clause 12. The cellulosic structure of Clause 10 or Clause 11 wherein a ratio of the polyolefin binder to the pigment is at least 1 to 2.

Clause 13. The cellulosic structure of any one of Clauses 1-12 wherein the single polyolefin aqueous polymer dispersion barrier layer has a coat weight, on a dry basis, of at least about 0.5 lb/3000 $ft^2$.

Clause 14. The cellulosic structure of any one of Clauses 1-12 wherein the single polyolefin aqueous polymer dispersion barrier layer has a coat weight, on a dry basis, ranging from about 0.5 lb/3000 $ft^2$ to about 20 lb/3000 $ft^2$.

Clause 15. The cellulosic structure of any one of Clauses 1-12 wherein the single polyolefin aqueous polymer dispersion barrier layer has a coat weight, on a dry basis, ranging from about 3 lb/3000 $ft^2$ to about 12 lb/3000 $ft^2$.

Clause 16. The cellulosic structure of any one of Clauses 1-12 wherein single polyolefin aqueous polymer dispersion barrier layer has a coat weight, on a dry basis, ranging from about 6 lb/3000 $ft^2$ to about 10 lb/3000 $ft^2$.

Clause 17. The cellulosic structure of any preceding clause wherein the non-polyolefin aqueous polymer dispersion barrier layer comprises a non-polyolefin binder.

Clause 18. The cellulosic structure of Clause 17 wherein the non-polyolefin binder comprises at least one of a styrene acrylic binder, a styrene-butadiene binder, a vinyl acrylic binder, and a polyester dispersion binder.

Clause 19. The cellulosic structure of Clause 17 or Clause 18 wherein the non-polyolefin aqueous polymer dispersion barrier layer comprises a pigment.

Clause 20. The cellulosic structure of Clause 19 wherein the pigment comprises at least one of a clay and a calcium carbonate.

Clause 21. The cellulosic structure of Clause 19 or Clause 20 wherein a ratio of the non-polyolefin binder to the pigment is at least 1 to 2.

Clause 22. The cellulosic structure of any preceding clause wherein the at least one non-polyolefin aqueous polymer dispersion barrier layer comprises multiple non-polyolefin aqueous polymer dispersion barrier layers.

Clause 23. The cellulosic structure of any one of Clauses 1-22 wherein the non-polyolefin aqueous polymer dispersion barrier layer has a coat weight, on a dry basis, of at least about 0.5 lb/3000 $ft^2$.

Clause 24. The cellulosic structure of any one of Clauses 1-22 wherein the non-polyolefin aqueous polymer dispersion barrier layer has a coat weight, on a dry basis, ranging from about 0.5 lb/3000 $ft^2$ to about 20 lb/3000 $ft^2$.

Clause 25. The cellulosic structure of any one of Clauses 1-22 wherein the non-polyolefin aqueous polymer dispersion barrier layer has a coat weight, on a dry basis, ranging from about 3 lb/3000 $ft^2$ to about 12 lb/3000 $ft^2$.

Clause 26. The cellulosic structure of any one of Clauses 1-22 wherein non-polyolefin aqueous polymer dispersion barrier layer has a coat weight, on a dry basis, ranging from about 6 lb/3000 $ft^2$ to about 10 lb/3000 $ft^2$.

Clause 27. The cellulosic structure of any preceding clause further comprising at least one water soluble polymer barrier layer between the single polyolefin aqueous polymer dispersion barrier layer and the first major side of the cellulosic substrate.

Clause 28. The cellulosic structure of Clause 27 wherein the water soluble polymer barrier layer is between the single polyolefin aqueous polymer dispersion barrier layer and the at least one non-polyolefin aqueous polymer dispersion barrier layer.

Clause 29. The cellulosic structure of Clause 27 wherein the water soluble polymer barrier layer is between the at least one non-polyolefin aqueous polymer dispersion barrier layer and the first major side of the cellulosic substrate.

Clause 30. The cellulosic structure of any one of Clauses 27-29 wherein the water soluble polymer barrier layer comprises a water soluble binder.

Clause 31. The cellulosic structure of Clause 30 wherein the water soluble binder comprises at least one of a polyvinyl alcohol binder, a carboxymethylcellulose binder, and an alginate binder.

Clause 32. The cellulosic structure of Clause 30 wherein the water soluble binder comprises a polyvinyl alcohol binder.

Clause 33. The cellulosic structure of any one of Clauses 30-32 wherein the water soluble polymer barrier layer further comprises a pigment.

Clause 34. The cellulosic structure of Clause 33 wherein the pigment comprises at least one of a clay and a calcium carbonate.

Clause 35. The cellulosic structure of Clause 33 or Clause 34 wherein a ratio of the water soluble binder to the pigment is at least 1 to 1.

Clause 36. The cellulosic structure of any one of Clauses 27-35 wherein the at least one water soluble polymer barrier layer comprises multiple water soluble polymer barrier layers.

Clause 37. The cellulosic structure of any one of Clauses 27-36 wherein the at least one water soluble polymer barrier layer has a coat weight, on a dry basis, of at least about 0.5 lb/3000 $ft^2$.

Clause 38. The cellulosic structure of any one of Clauses 27-36 wherein the at least one water soluble polymer barrier layer has a coat weight, on a dry basis, ranging from about 0.5 lb/3000 $ft^2$ to about 20 lb/3000 $ft^2$.

Clause 39. The cellulosic structure of any one of Clauses 27-36 wherein the at least one water soluble polymer barrier layer has a coat weight, on a dry basis, ranging from about 1 lb/3000 $ft^2$ to about 10 lb/3000 $ft^2$.

Clause 40. The cellulosic structure of any one of Clauses 27-36 wherein the at least one water soluble polymer barrier layer has a coat weight, on a dry basis, ranging from about 3 lb/3000 $ft^2$ to about 5 lb/3000 $ft^2$.

Clause 41. The cellulosic structure of any preceding clause further comprising one or more additional coating layers positioned between the single polyolefin aqueous polymer dispersion barrier layer and the first major side of the cellulosic substrate.

Clause 42. The cellulosic structure of any preceding clause wherein the second major side of the cellulosic substrate is uncoated.

Clause 43. The cellulosic structure of any one of Clauses 1-41 further comprising a barrier layer on the second major side of the cellulosic substrate.

Clause 44. The cellulosic structure of any one of Clauses 1-41 and 43 further comprising a non-barrier layer on the second major side of the cellulosic substrate.

Clause 45. The cellulosic structure of any one of Clauses 1-41,43 and 44 further comprising a clay coating layer on the second major side of the cellulosic substrate.

Clause 46. The cellulosic structure of any one of Clauses 1-45 having a 30-minute-water-Cobb rating of at most about 20 $g/m^2$.

Clause 47. The cellulosic structure of any one of Clauses 1-45 having a 30-minute-water-Cobb rating of at most about 10 $g/m^2$.

Clause 48. The cellulosic structure of any one of Clauses 1-45 having a 30-minute-water-Cobb rating of at most about 5 $g/m^2$.

Clause 49. The cellulosic structure of any one of Clauses 1-45 having a 30-minute-water-Cobb rating of at most about 4 $g/m^2$.

Clause 50. The cellulosic structure of any one of Clauses 1-45 having a 30-minute-water-Cobb rating of at most about 3 $g/m^2$.

Clause 51. The cellulosic structure of any one of Clauses 1-45 having a 30-minute-water-Cobb rating of at most about 2 $g/m^2$.

Clause 52. The cellulosic structure of any one of Clauses 1-51 having a water vapor transmission rate of less than 1000 grams per square meter per day at 38° C./90% RH.

Clause 53. The cellulosic structure of any one of Clauses 1-51 having a water vapor transmission rate of less than 500 grams per square meter per day at 38° C./90% RH.

Clause 54. The cellulosic structure of any one of Clauses 1-51 having a water vapor transmission rate of less than 400 grams per square meter per day at 38° C./90% RH.

Clause 55. The cellulosic structure of any one of Clauses 1-51 having a water vapor transmission rate of less than 300 grams per square meter per day at 38° C./90% RH.

Clause 56. The cellulosic structure of any one of Clauses 1-51 having a water vapor transmission rate of less than 200 grams per square meter per day at 38° C./90% RH.

Clause 57. The cellulosic structure of any one of Clauses 1-51 having a water vapor transmission rate of less than 100 grams per square meter per day at 38° C./90% RH.

Clause 58. The cellulosic structure of any one of Clauses 1-57 having oxygen transmission rate of less than 500 cc per square meter per day at 23° C./0% RH/100% O2.

Clause 59. The cellulosic structure of any one of Clauses 1-57 having oxygen transmission rate of less than 200 cc per square meter per day at 23° C./0% RH/100% O2.

Clause 60. The cellulosic structure of any one of Clauses 1-57 having oxygen transmission rate of less than 150 cc per square meter per day at 23° C./0% RH/100% O2.

Clause 61. The cellulosic structure of any one of Clauses 1-57 having oxygen transmission rate of less than 140 cc per square meter per day at 23° C./0% RH/100% O2.

Clause 62. The cellulosic structure of any one of Clauses 1-57 having oxygen transmission rate of less than 130 cc per square meter per day at 23° C./0% RH/100% O2.

Clause 63. The cellulosic structure of any one of Clauses 1-57 having oxygen transmission rate of less than 120 cc per square meter per day at 23° C./0% RH/100% O2.

Clause 64. The cellulosic structure of any one of Clauses 1-57 having oxygen transmission rate of less than 110 cc per square meter per day at 23° C./0% RH/100% O2.

Clause 65. The cellulosic structure of any one of Clauses 1-64 having a 3M kit test value is at least 5.

Clause 66. The cellulosic structure of any one of Clauses 1-64 having a 3M kit test value is at least 6.

Clause 67. The cellulosic structure of any one of Clauses 1-64 having a 3M kit test value is at least 7.

Clause 68. The cellulosic structure of any one of Clauses 1-64 having a 3M kit test value is at least 8.

Clause 69. The cellulosic structure of any one of Clauses 1-64 having a 3M kit test value is at least 9.

Clause 70. The cellulosic structure of any one of Clauses 1-64 having a 3M kit test value is at least 10.

Clause 71. The cellulosic structure of any one of Clauses 1-64 having a 3M kit test value is at least 11.

Clause 72. The cellulosic structure of any one of Clauses 1-64 having a 3M kit test value is at least 12.

Clause 73. The cellulosic structure of any one of Clauses 1-72 wherein the cellulosic structure has a blocking rating of 2.0 or less.

Clause 74. The cellulosic structure of any one of Clauses 1-72 wherein the cellulosic structure has a blocking rating of 1.5 or less.

Clause 75. The cellulosic structure of any one of Clauses 1-72 wherein the cellulosic structure has a blocking rating of 1.0 or less.

Clause 76. The cellulosic structure of any one of Clauses 1-72 wherein the cellulosic structure has a blocking rating of 0.7 or less.

Clause 77. The cellulosic structure of any one of Clauses 1-72 wherein the cellulosic structure has a blocking rating of 0.2 or less.

Clause 78. The cellulosic structure of any one of Clauses 1-72 wherein the cellulosic structure has a blocking rating of 0.1 or less.

Clause 79. The cellulosic structure of any one of Clauses 1-78 wherein the cellulosic structure is repulpable to an extent that after repulping a percentage of accepts is at least 50%.

Clause 80. The cellulosic structure of any one of Clauses 1-78 wherein the cellulosic structure is repulpable to an extent that after repulping a percentage of accepts is at least 70%.

Clause 81. The cellulosic structure of any one of Clauses 1-78 wherein the cellulosic structure is repulpable to an extent that after repulping a percentage of accepts is at least 80%.

Clause 82. The cellulosic structure of any one of Clauses 1-78 wherein the cellulosic structure is repulpable to an extent that after repulping a percentage of accepts is at least 85%.

Clause 83. The cellulosic structure of any one of Clauses 1-78 wherein the cellulosic structure is repulpable to an extent that after repulping a percentage of accepts is at least 90%.

Clause 84. A container comprising the cellulosic structure of any preceding clause.

Although various examples of the disclosed cellulosic structures have been shown and described, modifications may occur to those skilled in the art upon reading the specification. The present application includes such modifications and is limited only by the scope of the claims.

What is claimed is:

1. A cellulosic structure comprising:

a cellulosic substrate comprising a first major side and a second major side opposed from the first major side;

a single barrier layer on the first major side of the cellulosic substrate, the single barrier layer comprising a polyolefin aqueous polymer dispersion; and at least one non-polyolefin aqueous polymer dispersion barrier layer between the single barrier layer and the first major side of the cellulosic substrate; and at least one water soluble polymer barrier layer between the single barrier layer and the first major side of the cellulosic substrate, wherein the water soluble polymer barrier layer comprises a water soluble binder.

2. The cellulosic structure of claim 1 wherein the cellulosic substrate comprises paperboard.

3. The cellulosic structure of claim 1 wherein the single barrier layer comprises a polyolefin binder.

4. The cellulosic structure of claim 3 wherein the single barrier layer comprises a pigment.

5. The cellulosic structure of claim 4 wherein a ratio of the polyolefin binder to the pigment is at least 1 to 2.

6. The cellulosic structure of claim 1 wherein the single barrier layer has a coat weight, on a dry basis, of at least about 0.5 lb/3000 $ft^2$.

7. The cellulosic structure of claim 1 wherein the non-polyolefin aqueous polymer dispersion barrier layer comprises a non-polyolefin binder.

8. The cellulosic structure of claim 7 wherein the non-polyolefin binder comprises at least one of a styrene acrylic binder, a styrene-butadiene binder, a vinyl acrylic binder, and a polyester dispersion binder.

9. The cellulosic structure of claim 7 wherein the non-polyolefin aqueous polymer dispersion barrier layer comprises a pigment.

10. The cellulosic structure of claim 9 wherein a ratio of the non-polyolefin binder to the pigment is at least 1 to 2.

11. The cellulosic structure of claim 1 wherein the non-polyolefin aqueous polymer dispersion barrier layer has a coat weight, on a dry basis, of at least about 0.5 lb/3000 $ft^2$.

12. The cellulosic structure of claim 1 wherein the water soluble binder comprises at least one of a polyvinyl alcohol binder, a carboxymethylcellulose binder, and an alginate binder.

13. The cellulosic structure of claim 1 wherein the water soluble polymer barrier layer further comprises a pigment.

14. The cellulosic structure of claim 13 wherein a ratio of the water soluble binder to the pigment is at least 1 to 1.

15. The cellulosic structure of claim 1 wherein the at least one water soluble polymer barrier layer has a coat weight, on a dry basis, of at least about 0.5 lb/3000 $ft^2$.

16. The cellulosic structure of claim 1 further comprising a barrier layer on the second major side of the cellulosic substrate.

17. The cellulosic structure of claim 1 further comprising a non-barrier layer on the second major side of the cellulosic substrate.

18. The cellulosic structure of claim 1 having a 30-minute-water-Cobb rating of at most about 20 $g/m^2$.

19. The cellulosic structure of claim 1 having a water vapor transmission rate of less than 1000 grams per square meter per day at 38° C./90% RH.

20. The cellulosic structure of claim 1 having oxygen transmission rate of less than 500 cc per square meter per day at 23° C./0% RH/100% O2.

21. The cellulosic structure of claim 1 having a 3M kit test value is at least 5.

22. The cellulosic structure of claim 1 wherein the cellulosic structure has a blocking rating of 2.0 or less.

23. The cellulosic structure of claim 1 wherein the cellulosic structure is repulpable to an extent that after repulping a percentage of accepts is at least 50%.

24. A container comprising the cellulosic structure of claim 1.

25. The cellulosic structure of claim 1 wherein the water soluble polymer barrier layer is between the at least one non-polyolefin aqueous polymer dispersion barrier layer and the first major side of the cellulosic substrate.

26. A method for manufacturing a cellulosic structure, the method comprising:

providing a cellulosic substrate comprising a first major side and a second major side opposed from the first major side;

forming at least one non-polyolefin aqueous polymer dispersion barrier layer on the first major side of the cellulosic substrate;

forming at least one water soluble polymer barrier layer on the first major side of the cellulosic substrate, wherein the water soluble polymer barrier layer comprises a water soluble binder; and forming a single barrier layer on the first major side of the cellulosic substrate, the single barrier layer comprising a polyolefin aqueous polymer dispersion, wherein the at least one non-polyolefin aqueous polymer dispersion barrier layer is between the single barrier layer and the first major side of the cellulosic substrate, and wherein the at least one water soluble polymer barrier layer is between the single barrier layer and the first major side of the cellulosic substrate.

* * * * *